US006417769B1

(12) United States Patent
Jan

(10) Patent No.: US 6,417,769 B1
(45) Date of Patent: Jul. 9, 2002

(54) VOICE-CONTROLLED BURGLARPROOF DEVICE

(76) Inventor: Te-Chin Jan, 8 Fl., No. 21, Lane 120, Sec. 1, Neihu Rd., Neihu, Taipei (TW), 114

( * ) Notice: Subject to any disclaimer, the term of this patent is extended or adjusted under 35 U.S.C. 154(b) by 0 days.

(21) Appl. No.: 09/820,066

(22) Filed: Mar. 27, 2001

(51) Int. Cl.[7] ..... G08B 13/00
(52) U.S. Cl. ..... 340/541; 340/540; 340/565
(58) Field of Search ..... 340/521, 522, 340/541, 545.2, 540, 565; 379/351, 372, 386; 607/57, 137

(56) References Cited

U.S. PATENT DOCUMENTS 4,591,834 A * 5/1986 Kyle ..... 340/566
5,162,168 A * 11/1992 Downing et al. ..... 429/51
5,446,445 A * 8/1995 Bloomfield et al. ..... 340/521
5,446,446 A * 8/1995 Harman ..... 340/566
5,475,367 A * 12/1995 Prevost ..... 340/568.8
5,657,023 A * 8/1997 Culpepper et al. ..... 342/374
5,914,655 A * 6/1999 Clifton et al. ..... 340/541

* cited by examiner

*Primary Examiner*—Van T Trieu
(74) *Attorney, Agent, or Firm*—Klein & Szekeres, LLP

(57) ABSTRACT

A burglarproof device is arranged to take advantage of voice as the medium for detecting a burglar. The burglarproof device includes a voice sensing device, such as a microphone, for sensing the burglar's voice and generating a group of analog signals responsive to the burglar's voice, a burglarproof signal generating module for processing the analog signals and, in response thereto, generating alarm signals, and a sound playing device, such as a speaker, for broadcasting the alarm signals to warn the burglar against intruding, and further to prevent the burglar from intrusion.

19 Claims, 3 Drawing Sheets

VOICE-CONTROLLED BURGLARPROOF DEVICE

FIELD OF THE INVENTION

The present invention is associated with a burglarproof device, and more particularly the present invention is associated with a voice-controlled burglarproof device.

DESCRIPTION OF THE RELATED ART

At present, the burglarproof device is extensively arranged in household habitations and business offices to sense the circumambient movement, and can give an alarm signal to warn the burglar if a burglar is detected. Typically, the burglarproof device today utilizes either passive infrared detector or radar detector as the sensing element for sensing the circumambient movement to detect whether a burglar is intruded into the space. However, if a passive infrared detector which senses the heat of an object to detect the burglar is employed as a sensing element for the burglarproof device, the movement external to the space where the burglarproof device locates and the movement of burglar who is insulated from the sensing range of the passive infrared detector is not possible to be detected. As a result, the burglarproof device using a passive infrared detector as its sensing element has an inherent restriction in applications. On the other hand, if a radar detector which utilizes radio radiation to sense the movement of an object is employed as the sensing element for the burglarproof device, it is somewhat unsatisfied because the radar detector has a considerably high cost. Specifically, when the cost of the burglarproof device is to be concerned, unquestionably, using radar detector as the sensing element for the burglarproof device can not meet with the design requirements.

In consideration of restrictions imposed on the applications involved with using passive infrared detector or radar detector as the sensing element for the burglarproof device, the applicant considers that if voice is selected as the medium for detecting the burglar, it can subserve the burglarproof device of the prior art to detect the burglar on the conditions of where the passive infrared detector and the radar detector are unsatisfied to be applied thereto. Moreover, the detecting circuitry of the burglarproof device which takes advantage of voice as the sensing medium has a lower cost, and thus it is more feasible for the design of the burglarproof device. There tends to develop a voice-controlled burglarproof device which employs voice as the medium to detect the burglar, and can give an alarm signal, for example, barks to warn the burglar if the voice of the burglar (for example, footfall, clash, door bell ringing, knocking the door) is detected, and further prevent burglar from intrusion.

SUMMARY OF THE INVENTION

Consequently, an object of the present invention is to provide a voice-controlled burglarproof device which utilizes voice as the medium for detecting the burglar and gives an alarm signal to warn the burglar for preventing the burglar from intrusion if the voice of the burglar is detected.

According to a preferred embodiment of the present invention, the burglarproof device of the present invention comprises a voice sensing device for sensing a voice signal and outputting a group of analog signals responsive to the voice signal, and a burglarproof signal generating module for processing the analog signals to generate an alarm signal.

The voice sensing device may preferably comprise a microphone, and the burglarproof signal generating module may comprise a linear integrated circuit for amplifying the analog signals and converting the analog signals into linear signals, a linear-digital converting circuit for converting the linear signals into digital signals, and a digital audio integrated circuit for outputting audio signals in response to the trigger caused by the digital signals. Furthermore, the burglarproof signal generating module includes an amplifier for amplifying these audio signals as the alarm signal provided for warning the burglar off.

The linear integrated circuit may comprise an operational amplifier, and the linear-digital converting circuit is implemented with two NAND gates. The burglarproof device according to a preferred embodiment may optionally include a power supply conditioning circuit, which is configured to intermittently condition the period for supplying electric power to the linear integrated circuit. The power supply conditioning circuit is also implemented with two NAND gates, as the same with the linear-digital converting circuit described above. More importantly, the linear-digital converting circuit and the power supply conditioning circuit can be packaged in a single logic integrated circuit chip, such as a quad 2-input NAND gates logic integrated circuit.

The amplifier provided for amplifying the audio signal from the output of the digital audio integrated circuit is preferably implemented with a bipolar junction transistor (BJT). Besides, the burglarproof device of the present invention further includes a sound playing device such as a speaker to be an audio output interface for broadcasting the alarm signal to warn the burglar against intruding.

Now the foregoing and other features and advantages of the present invention will be more clearly understood through the following descriptions with reference to the accompanying drawings, in which:

DETAILED DESCRIPTION OF THE PREFERRED EMBODIMENT

Figure 1:
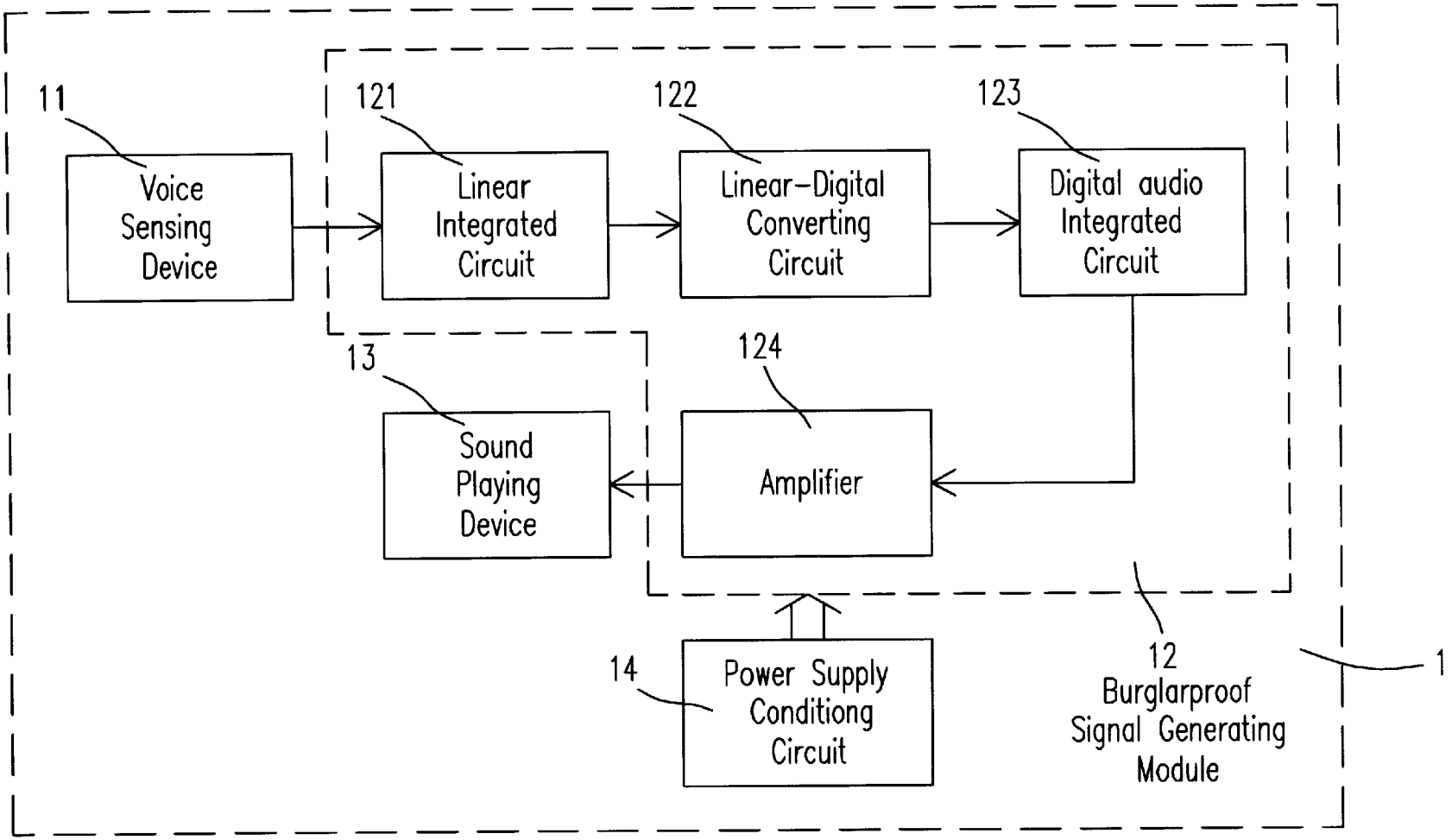
FIG. 1 schematically depicts a block diagram of burglarproof device according to a preferred embodiment of the present invention.

Referring now to FIG. 1, according to a preferred embodiment of the present invention, the burglarproof device 1 of the present invention may broadly comprise a voice sensing device 11, a burglarproof signal generating module 12, and a sound playing device 13. The voice sensing device 11 according to this preferred embodiment is implemented with a sound reception apparatus which is sensitive to external voice signals. If a burglar is intruded into the space where the burglarproof device locates and make voices, the voice sensing device 11 receives the voice signal and outputting a group of analog signals in response to the voice signal. The burglarproof signal generating module 12 will process the analog signals and generate alarm signals provided for warning the burglar against intruding.

As shown in FIG. 1, the burglarproof signal generating module 12 comprehends a linear integrated circuit 121, a linear-digital converting circuit 122, a digital audio integrated circuit 123, and an amplifier 124. The linear integrated circuit 121 is used to amplify the analog signals from the output of the voice sensing device 11 and convert the analog signals into linear signals. The linear signals are then fed to the linear-digital converting circuit 122 to be converted into digital signals. These digital signals are treated as the triggering signal for the digital audio integrated circuit 123. The digital audio integrated circuit 123 receives the triggering signal and in response thereto, outputs audio signals. The audio signals can be, but not limited to, barks, to frighten the burglar away. These audio signals are subsequently amplified by the amplifier 124 to be served as alarm signals. The alarm signals such as barks are broadcasted by the sound playing device 13 to warn the burglar away. The burglarproof device according to a preferred embodiment of the present invention may optionally include a power supply conditioning circuit 14 for intermittently conditioning the period for supplying electric power to the burglarproof signal generating module 12 for energy saving effect.

Figure 2:
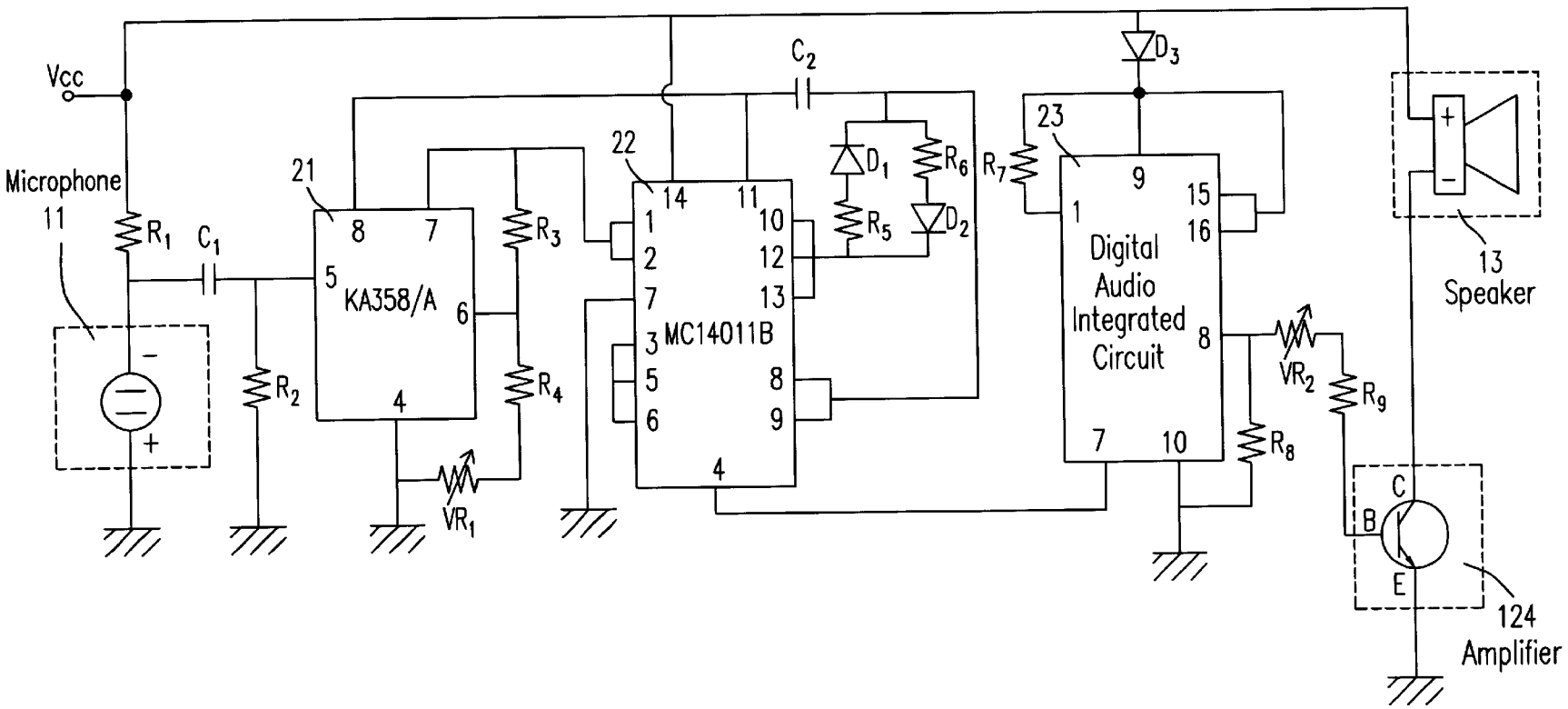
FIG. 2 is a plane view showing the circuit layout arrangement of the burglarproof device according to the preferred embodiment of FIG. 1.

FIG. 2 illustrates the detailed circuit layout arrangement of the burglarproof device according to the preferred embodiment of FIG. 1. The elements of FIG. 2 with the same reference numeral as those of FIG. 1 are directed to the same elements. The voice sensing device 11 of FIG. 1 is embodied in a microphone 11 as shown in FIG. 2. In FIG. 2, the linear integrated circuit 121 of FIG. 1 is embodied in a KA358/A linear integrated circuit 21, manufactured by Samsung Electronics Co., Ltd., The KA358/A linear integrated circuit 21 as well known in the art consists of dual operational amplifiers (not shown). The KA358/A's operational amplifier is used to amplify the analog signals from the microphone 11, and the gain of the individual operational amplifier can be indicated by the following equation:

$$\frac{R_3}{R_4 + VR_1}$$

The digital audio integrated circuit 23 is preloaded by audio signals such as barks, and is capable of outputting audio signals in response to the trigger caused by digital signals. The amplifier 124 of the burglarproof device according to the present invention is embodied in a bipolar junction transistor (BJT) 124 as shown in FIG. 2, and the sound playing device 13 of the burglarproof device according to the present invention is embodied in a speaker 13 as shown in FIG. 2.

Figure 3A:
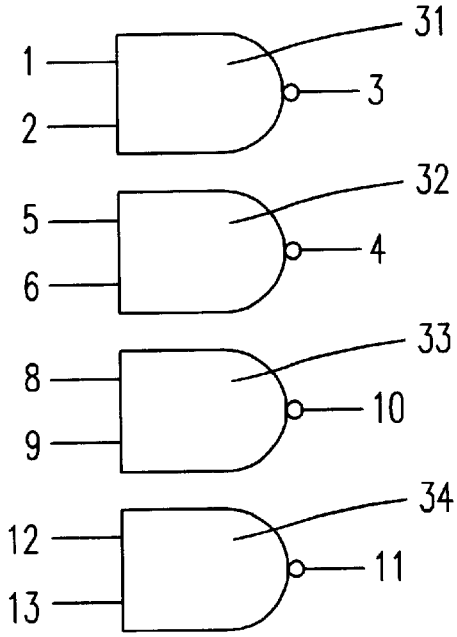
FIG. 3(*a*) and FIG. 3(B) respectively illustrates the logic diagram and pin assignment of the MC 140111B logic integrated circuit manufactured by Motorola, Inc.
Figure 3B:
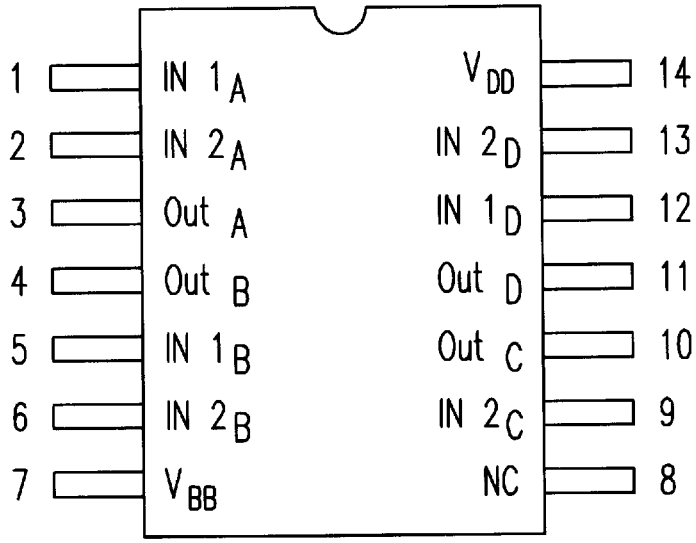

In particular, the linear-digital converting circuit 122 and the power supply conditioning circuit 14 shown in FIG. 1 can be packaged in a single logic gate integrated circuit chip. In this preferred embodiment, the logic gate integrated circuit chip that implement both of the functions of converting the linear signals into digital signals and intermittently conditioning the period for supplying electric power to the linear integrated circuit 21 is accomplished with a quad 2-input NAND gates logic IC, such as MC 140111B logic integrated circuit 22, manufactured by Motorola, Inc. FIG. 3(*a*) and FIG. 3(*b*) respectively demonstrates the logic diagram and pin assignment of the MC 14011B logic integrated circuit 22. NAND gates 31 and 32 can be taken to implement the linear-digital converting circuit 122 of FIG. 1, and NAND gates 33 and 34 can be taken to implement the power supply conditioning circuit 14 of FIG. 1. The linear-digital converting circuit formed by NAND gates 31 and 32 is applied to convert the linear signals from the output of the linear integrated circuit 21 into digital signals, and these digital signal are treated as the triggering signals for the digital audio integrated circuit 23.

The NAND gates 33 and 34 function as a high frequency timer for outputting high frequency pulse signals. As shown in FIG. 2, the resistors (R5, R6) and the diodes (D1, D2) form a power regulation unit, and their operation is controlled by the high frequency pulse signals from the outputs of the NAND gates 33 and 34 to charge/discharge the capacitor C2, whereby intermittently conditioning the period for supplying electric power to the linear integrated circuit 21 which is required to consecutively work in idle mode. In addition, the power required to operate the burglarproof device of the present invention Vcc can be alternatively supplied by a battery cell. Accordingly, the burglarproof device of the present invention can be more power-saving.

It is to be clearly understood that the burglarproof device of the present invention utilizes voice as the medium for detecting the burglar, and can give an alarm signal to frighten the burglar away if the burglar's voice is detected. The burglarproof device of the present invention adopts a voice sensing device such as a microphone for sensing the burglar's voice and includes a digital audio integrated circuit for being triggered to output audio signals such as barks to warn the burglars off. Because the cost of the detecting circuitry for the voice-controlled burglarproof device is far lower than that of the burglarproof device using passive infrared detector or radar detector as its sensing element, the burglarproof device of the present invention becomes more practical in many application where cost must be carefully considered, and it will consume less power if battery cell is selected as the power source for operating the burglarproof device.

Those of skill in the art will recognize that these and other modifications can be made within the spirit and scope of the invention as defined in the appended claims.

I claim:

1. A burglarproof device comprising:

a voice sensing device for sensing a voice signal and outputting a group of analog signals responsive to said voice signal; and a burglarproof signal generating module for processing said group of analog signals to generate an alarm signal, comprising:

a linear integrated circuit for amplifying said analog signals and converting said analog signals into linear signals;

a linear-digital converting circuit for converting said linear signals into digital signals; and a digital audio integrated circuit for receiving said digital signals, and in response thereto, outputting audio signals.

2. The burglarproof device as recited in claim 1 wherein said voice sensing device comprises a microphone.

3. The burglarproof device as recited in claim 1 wherein said linear integrated circuit comprises an operational amplifier.

4. The burglarproof device as recited in claim 1 wherein said linear-digital converting circuit comprises two NAND gates.

5. The burglarproof device as recited in claim 1 wherein said burglarproof signal generating module further comprises an amplifier for amplifying said audio signals as alarm signals.

6. The burglarproof device as recited in claim 5 wherein said amplifier comprises a bipolar junction transistor.

7. The burglarproof device as recited in claim 5 further comprising a sound playing device for broadcasting said alarm signal.

8. The burglarproof device as recited in claim 7 wherein said sound playing device comprises a speaker.

9. The burglarproof device as recited in claim 1 further comprising a power supply conditioning circuit for intermittently conditioning the period for supplying electric power to said burglarproof signal generating module.

10. The burglarproof device as recited in claim 9 wherein said power supply conditioning circuit comprises two NAND gates.

11. The burglarproof device as recited in claim 9 wherein said linear-digital converting circuit and said power supply conditioning circuit are packaged in a single integrated circuit chip.

12. A burglarproof device, comprising:

a voice sensing device for sensing a voice signal and outputting a group of analog signals responsive to said voice signal;

a linear integrated circuit for amplifying said analog signals and converting said analog signals into linear signals;

a logic gate integrated circuit in which a first part of said logic gate integrated circuit is configured to convert said linear signals into digital signals, and in which a second part of said logic gate integrated circuit is configured to intermittently condition the period for supplying electric power to said linear integrated circuit; and a digital audio integrated circuit for receiving said digital signals, and in response thereto, outputting audio signals.

13. The burglarproof device as recited in claim 12 wherein said voice sensing device comprises a microphone.

14. The burglarproof device as recited in claim 12 wherein said linear integrated circuit comprises an operational amplifier.

15. The burglarproof device as recited in claim 12 wherein said logic gate integrated circuit comprises a quad 2-input NAND gates logic integrated circuit.

16. The burglarproof device as recited in claim 12 further comprising an amplifier for amplifying said audio signals as alarm signals.

17. The burglarproof device as recited in claim 16 wherein said amplifier comprises a bipolar junction transistor.

18. The burglarproof device as recited in claim 16 further comprising a sound playing device for broadcasting said alarm signal.

19. The burglarproof device as recited in claim 18 wherein said sound playing device comprises a speaker.

* * * * *